US008327464B2

(12) United States Patent
Jaros

(10) Patent No.: US 8,327,464 B2
(45) Date of Patent: Dec. 11, 2012

(54) SLIDABLE PERMANENT FASTENER

(76) Inventor: Glenn Jaros, New Bern, NC (US)

( * ) Notice: Subject to any disclaimer, the term of this patent is extended or adjusted under 35 U.S.C. 154(b) by 318 days.

(21) Appl. No.: 12/795,223

(22) Filed: Jun. 7, 2010

(65) Prior Publication Data

US 2011/0296586 A1 Dec. 8, 2011

(51) Int. Cl.
*A41D 31/00* (2006.01)

(52) U.S. Cl. ..... 2/243.1; 2/275

(58) Field of Classification Search ..... 24/585.11, 24/702; 2/227, 228, 238, 243.1, 244, 236, 2/78, 218, 408, 237, 96, 235, 234
See application file for complete search history.

(56) References Cited

U.S. PATENT DOCUMENTS

| | | | | | |
|---|---|---|---|---|---|
| 668,401 | A | * | 2/1901 | Brown | 24/588.12 |
| 684,113 | A | | 4/1901 | Shaddle | |
| 1,719,856 | A | | 7/1929 | Sipe | |
| 1,734,422 | A | * | 11/1929 | Feit | 2/253 |
| 1,887,741 | A | * | 11/1932 | Trotter | 24/399 |
| 1,959,319 | A | | 5/1934 | Sipe | |
| 2,810,944 | A | * | 10/1957 | Sander | 24/400 |
| 3,066,501 | A | | 12/1962 | Charles et al. | |
| 3,338,285 | A | * | 8/1967 | Jaster et al. | 383/65 |
| 3,460,282 | A | | 8/1969 | Swirsky | |
| 3,495,306 | A | | 2/1970 | Eichberg | |
| 3,875,623 | A | | 4/1975 | Johnston | |
| 4,193,136 | A | | 3/1980 | Pierce | |
| 4,218,047 | A | | 8/1980 | Douglas | |
| 4,329,079 | A | | 5/1982 | Milding | |
| 4,935,995 | A | | 6/1990 | Daus, Jr. | |
| 4,941,238 | A | | 7/1990 | Clark | |
| 5,187,843 | A | | 2/1993 | Lynch | |
| 5,408,775 | A | | 4/1995 | Abramson | |
| 5,415,904 | A | | 5/1995 | Takubo | |
| 5,431,601 | A | | 7/1995 | Nakamura | |
| 5,471,684 | A | * | 12/1995 | Casale | 2/195.1 |
| 5,502,930 | A | | 4/1996 | Burkette | |
| 5,953,875 | A | | 9/1999 | Harkins | |
| 6,161,223 | A | * | 12/2000 | Andrews | 2/234 |
| 6,243,878 | B1 | | 6/2001 | Khemka | |
| 6,263,508 | B1 | * | 7/2001 | Davis | 2/10 |
| 6,438,811 | B1 | | 8/2002 | Watanabe | |
| 6,592,800 | B1 | | 7/2003 | Levitt | |
| 6,789,267 | B2 | * | 9/2004 | Ahn | 2/195.1 |
| 6,880,297 | B2 | | 4/2005 | Johnston | |
| D613,039 | S | * | 4/2010 | Viola et al. | D2/742 |
| 2001/0044991 | A1 | * | 11/2001 | Graves | 24/400 |
| 2005/0091728 | A1 | * | 5/2005 | Rocha | 2/227 |
| 2006/0156454 | A1 | * | 7/2006 | Han | 2/227 |
| 2007/0204376 | A1 | * | 9/2007 | Nunn | 2/69 |
| 2008/0271298 | A1 | | 11/2008 | Meager | |
| 2011/0191943 | A1 | * | 8/2011 | Johnson et al. | 2/244 |

* cited by examiner

*Primary Examiner* — Khoa Huynh
*Assistant Examiner* — Anna Kinsaul
(74) *Attorney, Agent, or Firm* — Marc E. Hankin; Kevin Schraven; Hankin Patent Law, APC

(57) ABSTRACT

The invention is a slidable fastening device that is sewn into a garment and replaces a static seam of the garment. The fastener has a male portion and a female portion that are permanently engaged with each other and slide up and down with respect to each other. The fastener is hidden from view such that a casual observer does not notice that the static seam has been replaced.

14 Claims, 10 Drawing Sheets

SLIDABLE PERMANENT FASTENER

FIELD OF THE INVENTION

This invention relates, generally, to a fastener. More specifically, the invention relates to a garment fastener that improves the fit of a garment on the buttocks of the human body by allowing two separate garment swatches to slidably move with respect to each other as the body moves. The invention is specifically designed to be used with form fitting pants or trousers, such a jeans, but the invention may be used with any fabric or article of clothing, including, but not limited to, denims, capri pants, skorts, slacks, shorts, bathing suits, underwear, and all other types of garments.

BACKGROUND OF THE INVENTION

Although pants for women did not become fashionable until late in the 20th century, currently, pants, and more specifically jeans are commonly worn by women. Indeed jeans have become quite stylish and feminine and are designed to not only cloth the wearer, but to enhance the shape of the wearer's body. Despite the many different styles and types of jeans, no jeans currently available in the marketplace have a seam that allows two parts of the jeans, such as a buttock portions, to slidably move with respect to each other.

There have been developed a wide variety of different assemblies to facilitate the joining of objects or fabric swatches to one to another in the fashion industry. The most common type of permanent fastener in the fashion industry is a stitched seam. The stitched seam is the line where two or more layers of fabric are held together by threads or stitching. The stitched seam allows the clothing manufacturer join two flat swatches of fabric together to create a variety of clothing articles, including those with a form fitting shape.

The stitched seam is designed to securely fasten two swatches of fabric together and it essentially prohibits the two swatches from slidably moving against each other. As such, the swatches joined together by the stitched seam move together like they are the same swatch.

In addition to the permanent fastener of stitching, there are many types of fasteners that are designed to temporarily fasten swatches of fabric together, such as zippers, buckles, buttons, hooks, loops, pins, laces, snaps, and hook and eye. Many of these fasteners use the principle of male to female connection such that a male portion matingly engages with the female portion. However, in addition to the limitation that these fasteners are designed to only temporarily join the two swatches, the vast majority of these fasteners do not allow the swatches to slidably move opposite each other.

Regarding specific references that disclose a female to male connector for use with fabric that may be slidable, U.S. Pat. No. 1,719,856, issued to Sipe, U.S. Pat. No. 1,959,319, also issued to Sipe, U.S. Pat. No. 3,875,623, issued to Johnston, and U.S. Pat. No. 4,939,995, issued to Daus, disclose such a fabric joint connector. Although the above references disclose a fabric joint connector, importantly none of those references are directed towards, or even hint at, a permanent slidable fabric joint connector that replaces where a stitched seam would normally be in order to allow movement in a garment as it is worn by a user.

Regarding references that disclose a male and female rib connector that may be slidable, U.S. Pat. No. 5,187,843, issued to Lynch, disclose such a fastener. However, the Lynch fastener is not a permanent fastener and it is directed at a releasable interconnection of two large objects that are combined to cover an even larger area Importantly, the Lynch fastener is designed to be easily disengagable without sliding the two objects apart.

Despite the long existence of the various connectors and fasteners discussed above, there remains a need for a permanent connector that allows two pieces of fabric to slide opposite to each other and may be used in a pair of form fitting pants to enhance the look of the movement of the buttocks of the wearer.

SUMMARY OF THE INVENTION

To minimize the limitations in the prior art, and to minimize other limitations that will become apparent upon reading and understanding the present specification, the present invention discloses a new and useful fastener device, which permanently fastens two pieces of fabric together but allows the two pieces of fabric to slide in opposite directions with respect to each other.

One embodiment of the invention is a fastener, comprising: a male rib and a female rib. The female rib is inserted into the male rib creating a permanently connected joint. The female rib and the male rib are slidable with respect to each other. Preferably the fastener also includes a male fabric portion and a female fabric portion. The male fabric portion is attached to the male rib and the female fabric portion is attached to the female rib. The fastener may also have a joint cover. The joint cover covers an outside portion of the joint such that the joint appears to be a standard stitched seam. Typically, the fastener is part of a wearable garment, such as a pair of jeans. The joint is preferably used to replace a vertical rear seam on a pair of jeans and the female and male fabric portions cover a buttocks of a garment wearer. The joint has an upper attachment and a lower attachment, which limit the slidable motion of the joint. Preferably the male and female of ribs are made out of plastic or polytetrafluoroethylene, such as Teflon®. The male rib has a rounded arrow shape and the female rib has an open end, which is shaped to accept the rounded arrow shaped male rib.

The fastener may be connected to itself by inserting the male rib into the female rib by pushing the male rib into the female rib such that the female rib widens said male rib and snaps into place. The rounded arrow shaped male rib preferably has one or more rounded back portions that when engaged with the female rib, prevents the male rib from being pulled free of the female rib. The joint allows the female fabric portion and the male fabric portion to move with the buttocks of the garment wearer as the garment wearer moves or walks.

Another embodiment of the invention is a pair of pants, comprising: two rear leg portions; a waist band portion; a male rib; a female rib; and a joint cover. The first of the two rear leg portions is attached to the male rib and the second of the two rear leg portions is attached to the female rib. The male rib is matingly engaged with the female rib forming a rear joint. The female rib and the male rib are slidable with respect to each other. The rear joint connects the two rear leg portions to each other to form a back side of a pair of pants. The rear joint allows the two rear leg portions to move with the buttocks of the garment wearer as the garment wearer moves or walks. The waist band portion conceals the top of the rear joint, the crotch of the garment has an extended flap and opening to allow the movement of the seam at the bottom, and the joint cover covers an outside portion of the rear joint such that the rear joint appears to be a standard stitched seam. Preferably the male rib has a rounded arrow shape and the female rib has an open end, which is shaped to accept the rounded arrow shaped male rib. Preferably the rounded arrow shaped male rib has one or more rounded back portions that when engaged with the female rib prevents the male rib from being pulled free of the female rib. This keeps the ribs permanently connected. The pair of pants is a pair of jeans. The ribs are preferably made out of plastic or polytetrafluoroethylene. The slidable motion is typically limited by an upper attachment and a lower attachment.

It is an object of the invention to overcome the limitations of the prior art.

It is a further object of the invention to provide a garment that slidably moves with the user to enhance the look of the user as he or she walks or moves.

The invention is a slidable joint that replaces a rear vertical seam of a pair of pants (or any other article of clothing) and allows the two buttock portions of the pair of pants or any other types of garment worn on the human buttocks, to slide up and down relative to each other.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

Figure 1:
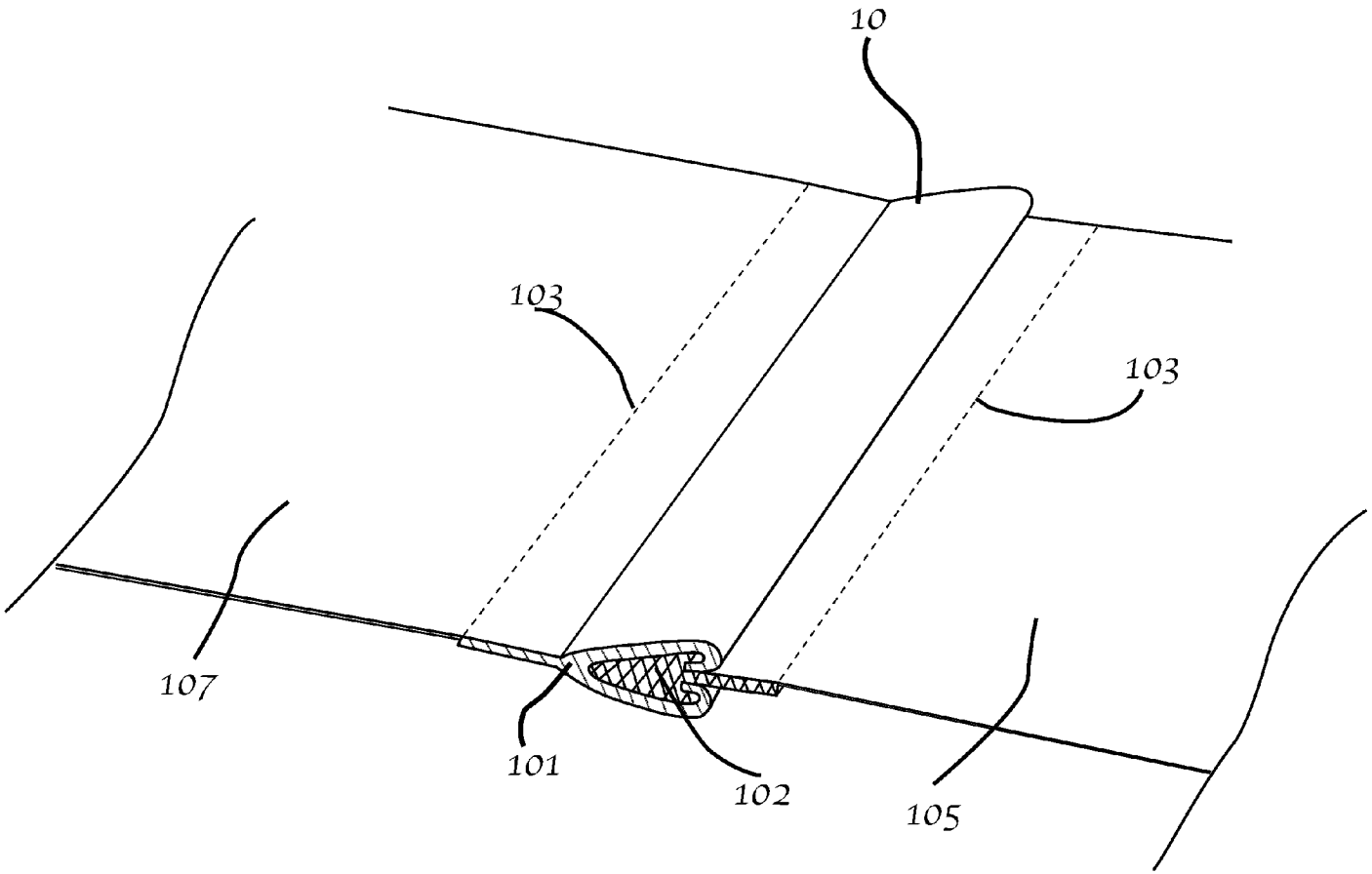
FIG. 1 is a detailed illustration of a perspective view of one embodiment of the fastener invention.

FIG. 1 is a detailed illustration of a perspective view of one embodiment of the fastener invention. As shown in FIG. 1, the fastener 10 is preferably comprised of female rib 101 and the male rib 102. The ribs are preferably made out of plastic or polytetrafluoroethylene (such as Teflon®), but can be made from any natural or synthetic material, including, but not limited to: metal; metal alloy; wood or other fibrous plant product such as hemp, paper, or cardboard; glass; composite materials such as graphite, fiberglass, boron, or aramid fibers; admixtures of plastic resins combined with metal, metal alloy, wood or other fibrous plant product, glass, or composite materials; plastic; animal materials such as wool, bone, or hardened leather; or any combination of these materials, without departing from the scope of the present invention.

The ribs 101 and 102 are preferably directly attached to pieces or swatches of fabric (or other natural or synthetic textile material) 105 and 107. In this manner, and as shown in FIG. 1, when the male rib 102 is engaged with female rib 101, the two pieces of attached cloth are joined in a side by side joint. As such, the fastener may also be referred to as a joint. FIG. 1 shows how the ribs 101 and 102 are attached to the fabric or other textile material through stitching 103, but they may be attached through any means, including, but not limited to: straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding.

Figure 2:
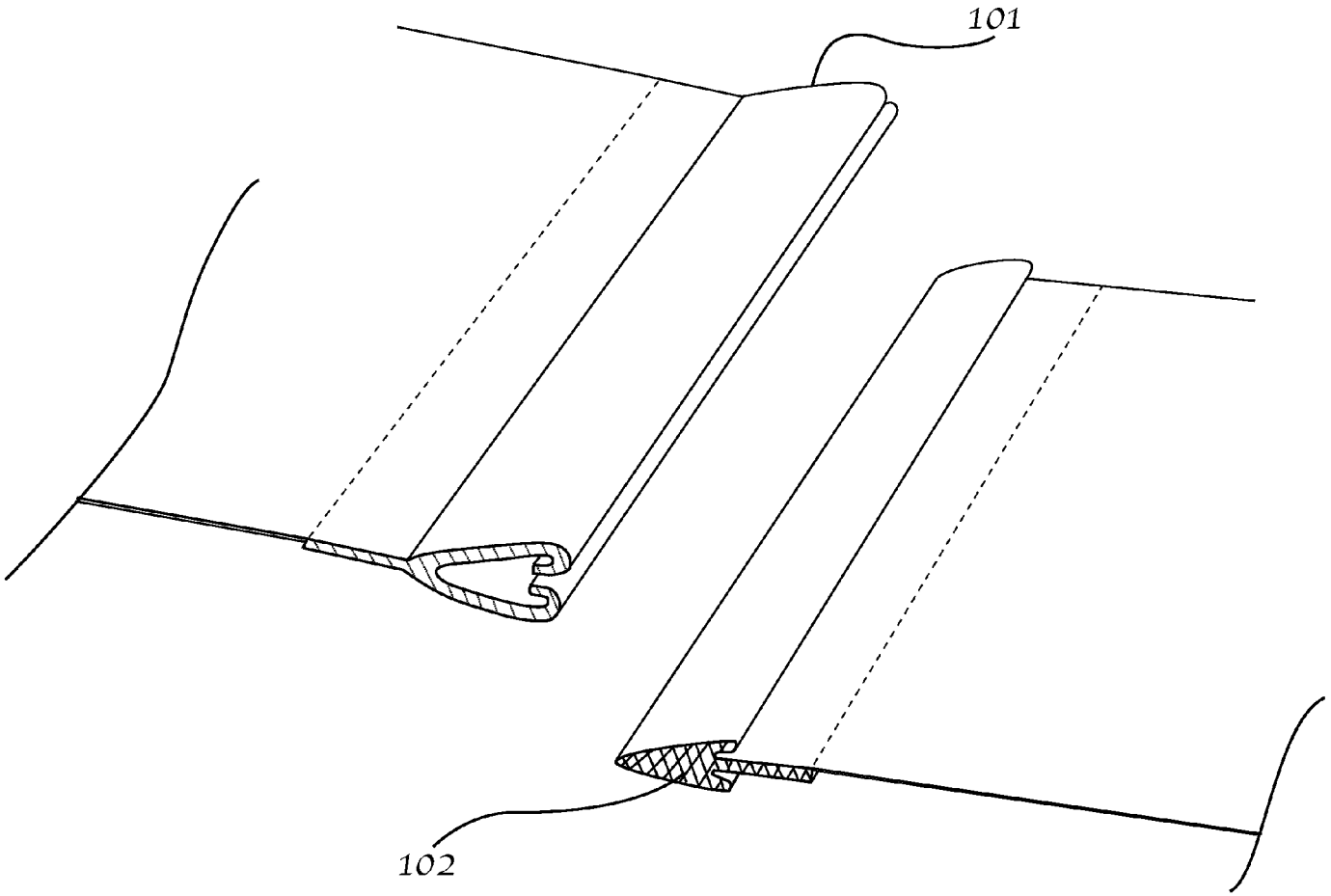
FIG. 2 is a detailed illustration of a perspective view of one embodiment of the fastener invention showing the male and female ribs separated.

FIG. 2 is a detailed illustration of a perspective view of one embodiment of the fastener invention showing the male and female ribs separated. As shown in FIG. 2, the female rib 101 and the male rib 102 may be separate pieces. FIG. 2 also shows how male rib 102 is a rounded arrow shape that may be slid into or snapped matingly into female rib 101.

Figure 3:
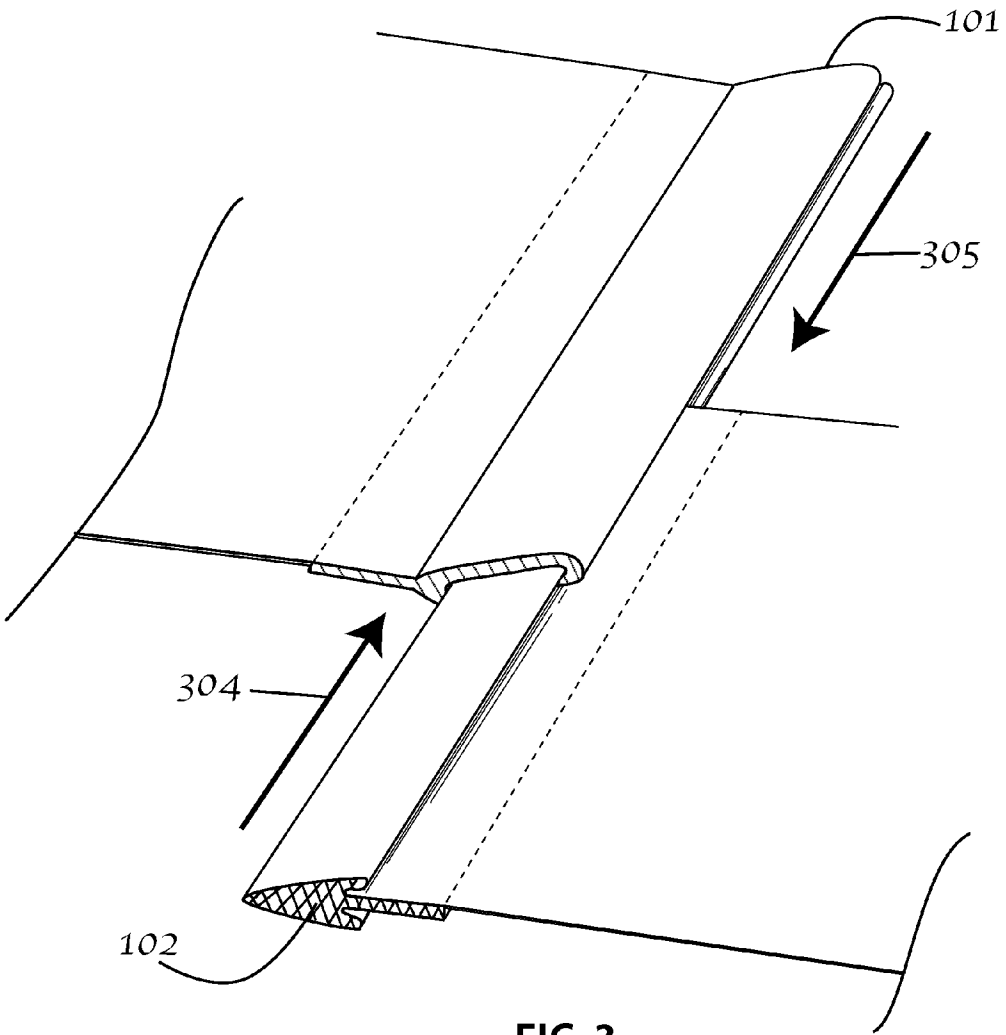
FIG. 3 is a detailed illustration of a perspective view of one embodiment of the fastener invention showing the male and female ribs sliding with respect to each other.

FIG. 3 is a detailed illustration of a perspective view of one embodiment of the fastener invention showing the male and female ribs sliding with respect to each other. As shown in FIG. 3, male rib 102 is preferably designed to matingly fit within female rib 101. Arrows 304 and 305 show how the male rib 102 and female rib 101 may slide in opposite directions to each other.

Figure 4:
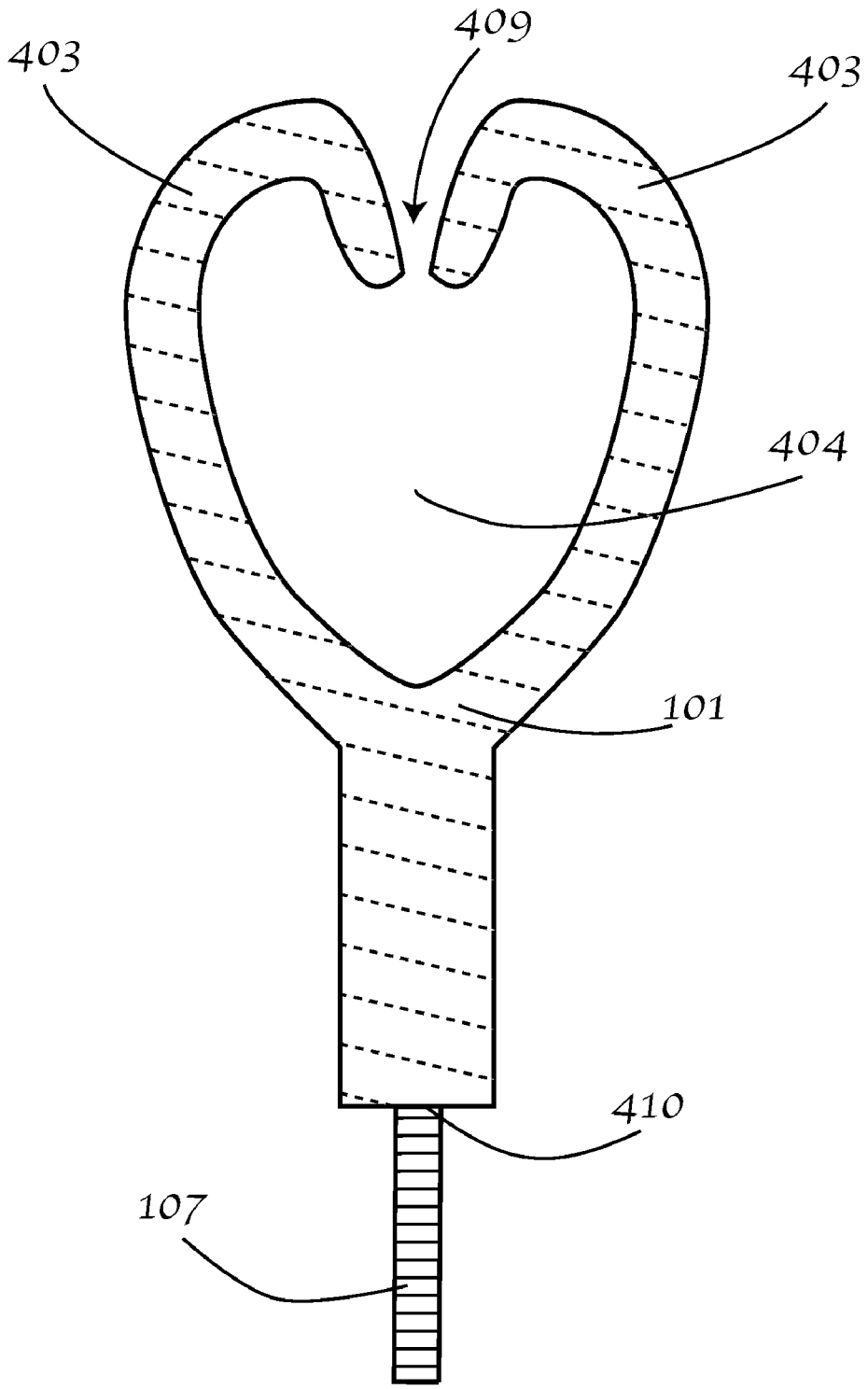
FIG. 4 is a detailed illustration of a side view of one embodiment of the fastener invention showing the female ribs.
Figure 5:
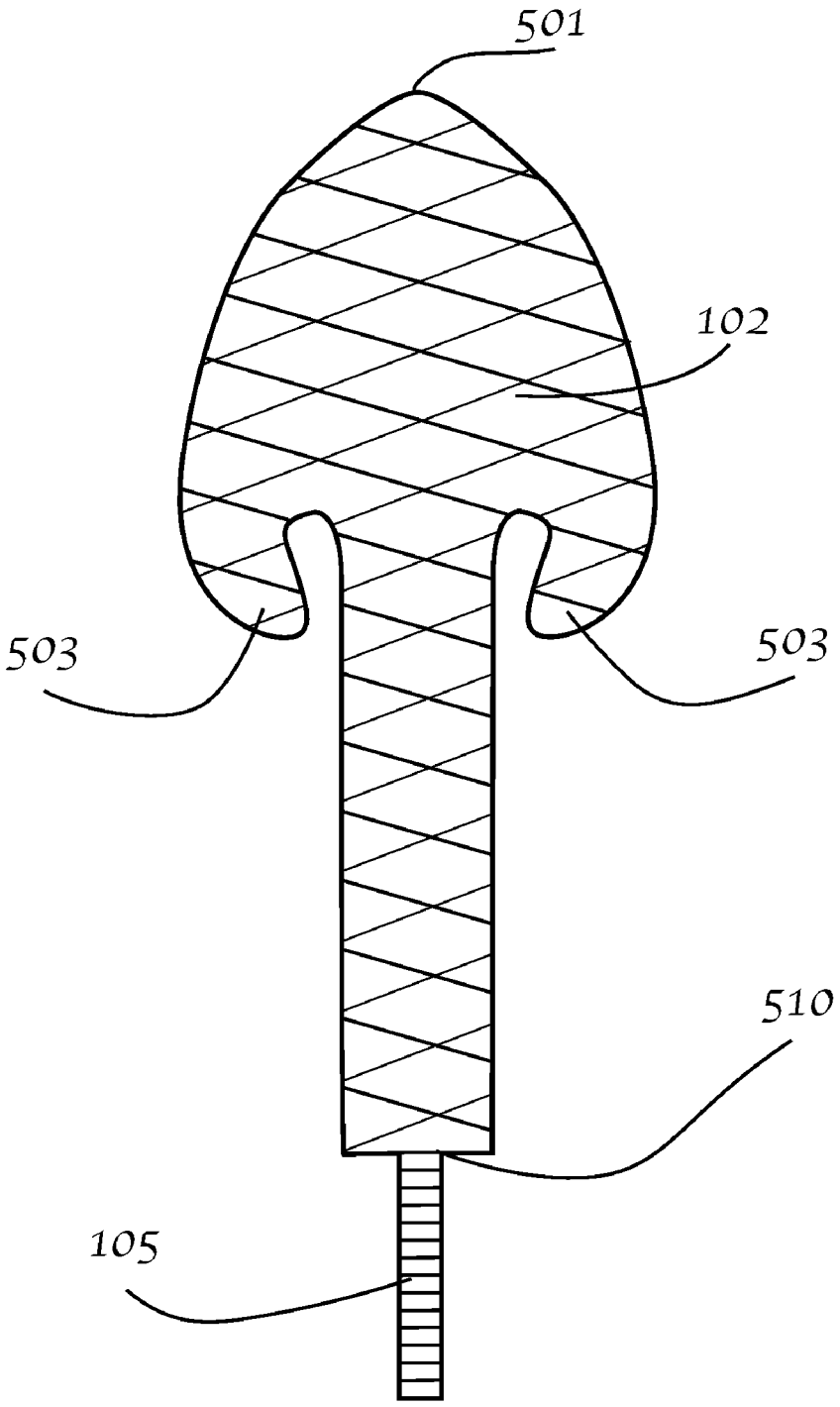
FIG. 5 is a detailed illustration of a side view of one embodiment of the fastener invention showing the male ribs.

FIG. 4 is a detailed illustration of a side view of one embodiment of the fastener invention showing the female portion. As shown in FIG. 4, the female rib 101 preferably has two hooks 403, heart shaped interior 404, opening 409, and connection 410 to fabric 107. FIG. 4 shows how female rib is able to accept the heart shaped male rib (as shown in FIG. 5). Preferably the two hooks 403 are flexible enough to allow the male rib to push past and permanently snap into place.

FIG. 5 is a detailed illustration of a side view of one embodiment of the fastener invention showing the male rib. As shown in FIG. 5, the male rib 102 is preferably comprised of point 501, rounded back portions 503, and connection 510 to fabric 105. FIG. 5 shows how male rib 102 is designed to slide or snap into the female rib (as shown in FIG. 4).

Figure 6:
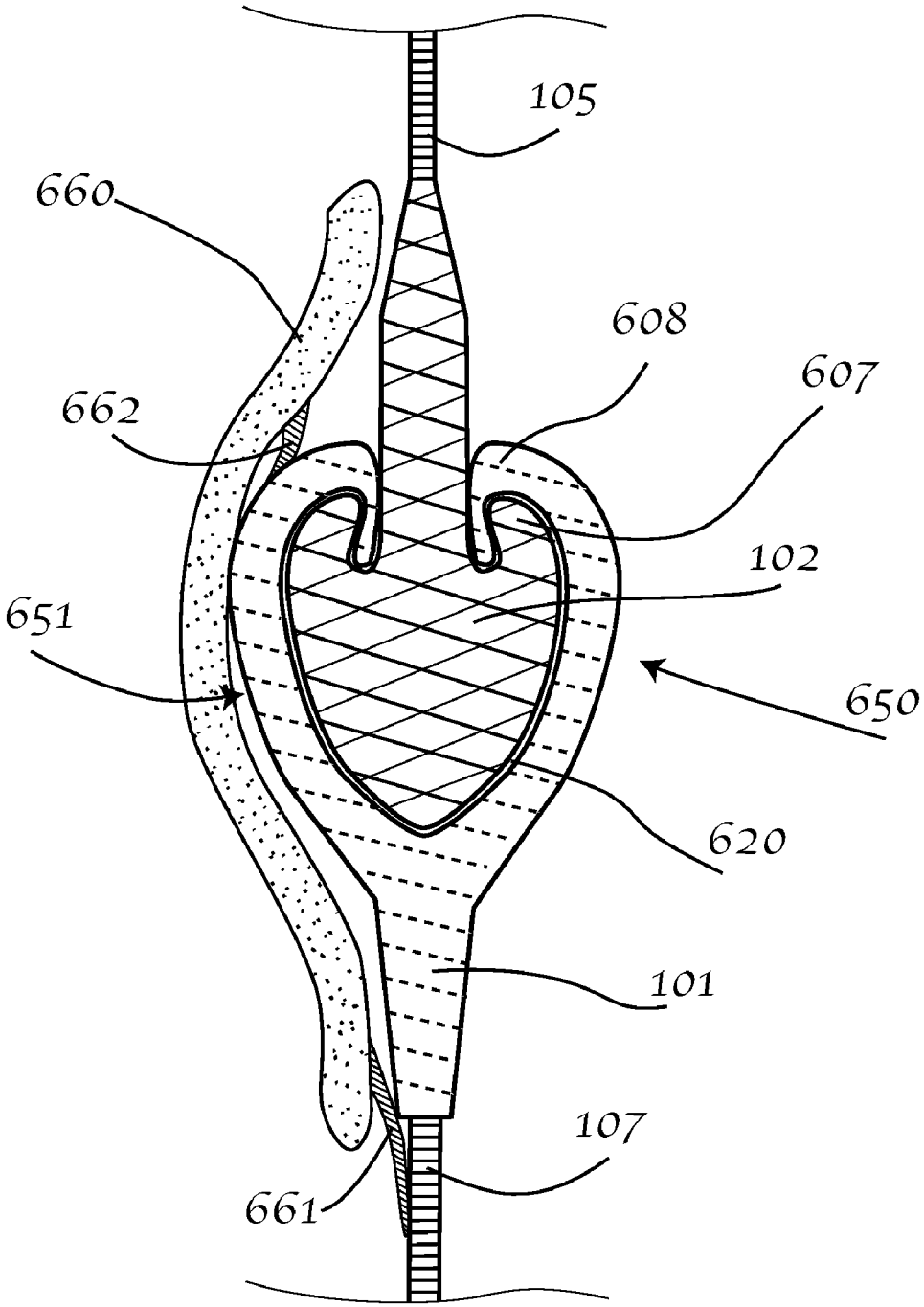
FIG. 6 is a close up illustration of a side view of one embodiment of the fastener invention and shows the joint cover.

FIG. 6 is a close up illustration of a side view of one embodiment of the fastener invention. As shown in FIG. 6 a female rib 101 and male rib 102 are matingly engaged to each other and are attached to fabric 105 and 107. FIG. 6 also shows how the ribs 101 and 102 have an inside 650 and an outside 651. Preferably, the outside 651 is concealed by a joint cover 660. Joint cover 660 is preferably attached to one of the ribs and/or the fabric that is attached to one of the ribs. FIG. 6 shows that joint cover 660 is attached to fabric 107 through connection 661 and to female rib 101 through connection 662. In this manner, joint cover 660 conceals the fastener assembly and joint cover 660 only moves with the one side of the fastener to which it is connected. The joint cover and the rib may be connected via any means, but preferably connections 661 and 662 are stitches or glue.

FIG. 6 also shows how female rib 101 and male rib 102 fit snuggly together. Space 620 is shown as an exaggerated space for purposes of illustration. Preferably space 620 would essentially be non-existent when the two ribs are matingly engaged. FIG. 6 shows how when hooks 608 are engaged with rounded back portions 607, the male rib 102 cannot be pulled horizontally out from female rib 101. This provides that female rib 101 and male rib 102 are permanently, but slidably, engaged.

FIG. 6 shows how the male rib 102 is preferably rounded and arrow or heart shaped and the female rib 101, is designed to matingly receive the arrow or heart shaped male rib 102. However, the ribs may be any shape, including, but not limited to triangular, square, round, or cylindrical without deviating from the scope of the invention.

Figure 7:
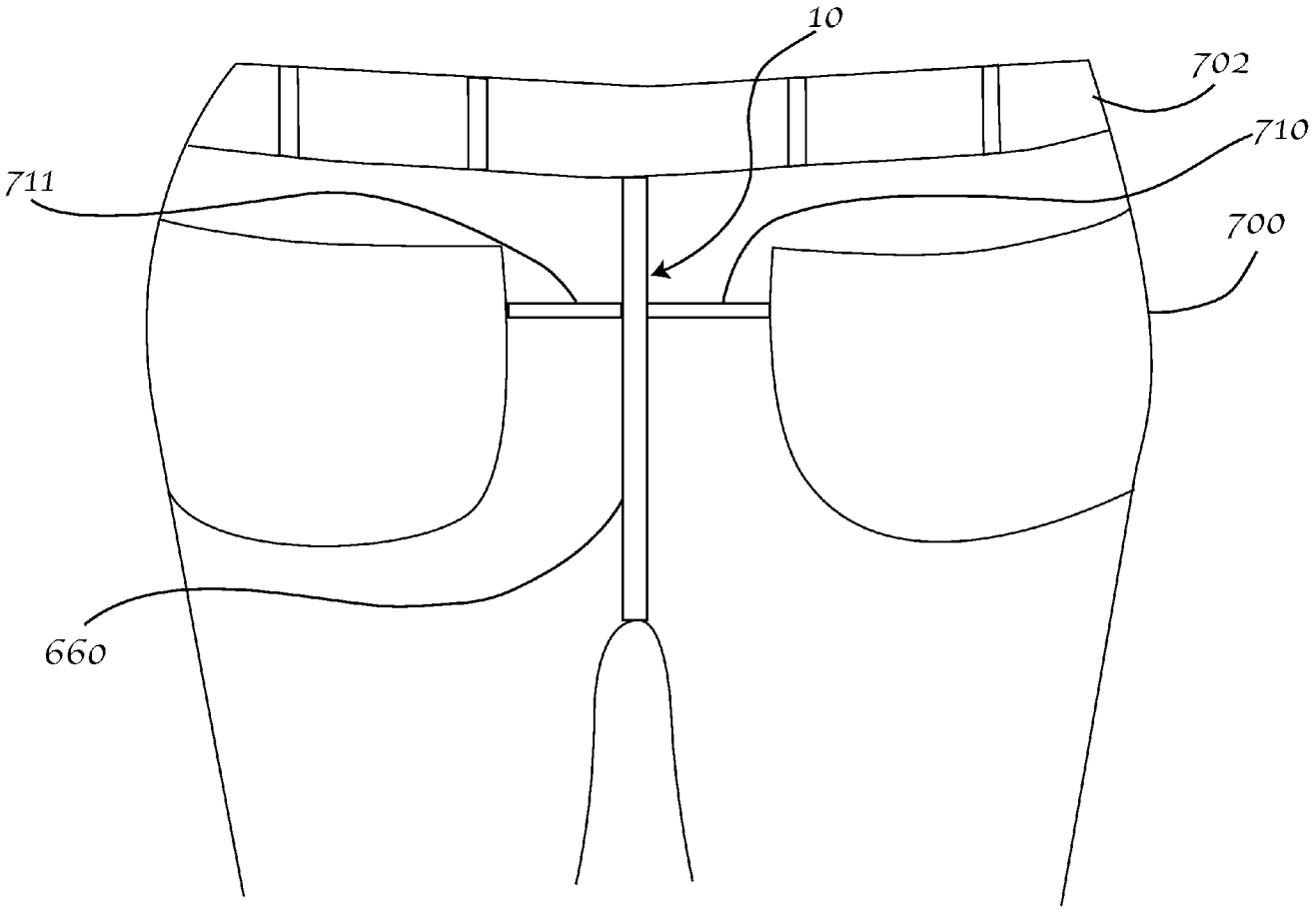
FIG. 7 is a detailed illustration of a rear view of a pair of pants with one embodiment of the fastener invention replacing the rear seam of the pair of pants.

FIG. 7 is a detailed illustration of a rear view of a pair of pants with one embodiment of the fastener invention replacing the rear seam of the pair of pants. As shown in FIG. 7, the fastener 10 has been added to a pair of pants 700. The pair of pants 700 are preferably jeans, and include a waist band 702, joint cover 660, and design strips 710 and 711. The ribs of fastener 10 are not visible in FIG. 7 because they are concealed by joint cover 660. Fastener 10 is preferably incorporated into the jeans by bonding or stitching, but any connection means may be used without deviating from the scope of the invention. Waist band 702 provides additional concealment for the upper attachment (as shown in FIG. 8).

FIG. 7 shows how the fastener 10 has replaced a rear vertical seam on a pair of jeans. However, it should be understood that fastener 10 may replace any seam on any article of clothing or fabric connection without deviating from the scope of the invention.

Figure 8:
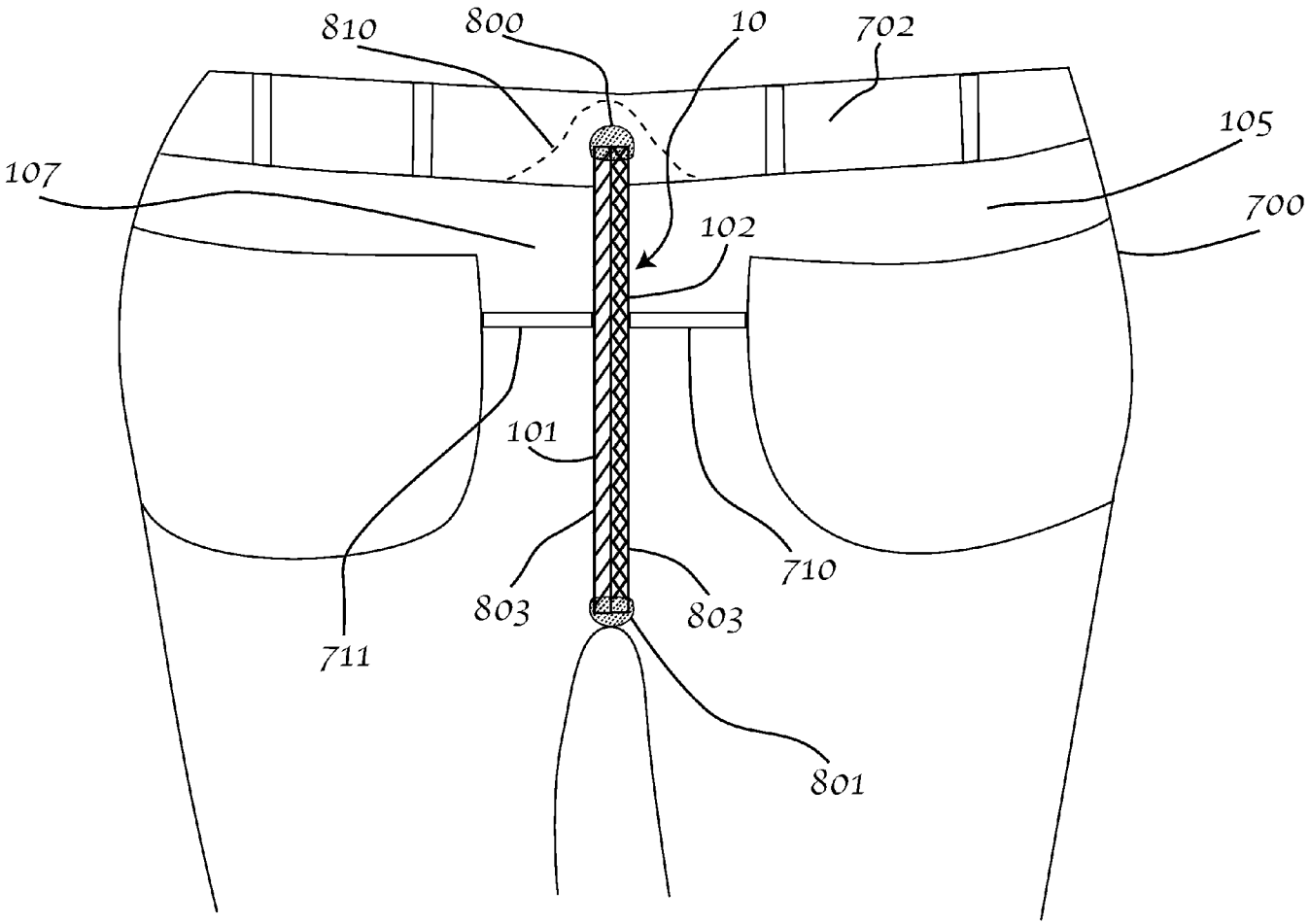
FIG. 8 is a close up illustration of a rear view of a pair of pants with one embodiment of the fastener invention and shows how the fastener allows the two sides of the pair of pants slidably move with respect to each other.

FIG. 8 is a close up illustration of a rear view of a pair of pants with one embodiment of the fastener invention and shows how the fastener allows the two sides of the pair of pants slidably move with respect to each other. As shown in FIG. 8, the fastener 10 has been added to a pair of pants 700. The pair of pants 700 are preferably jeans, and include a waist band 702, design strips 710 and 711, female rib 101, male rib 102, fabric swatches or portions 105 and 107, connections 803, upper attachment 800, and lower attachment 801. FIG. 8 shows fastener 10 without the joint cover. Upper and lower attachments 800 and 801 preferably limit the female and male ribs 101 and 102 ability to slide up and down opposite each other. Waist band 702 is shown with cut-out 810 so that the upper attachment 800 position is visible. The two design strips 710 and 711 show that the fastener 10 is not moving or sliding in any direction.

Figure 9:
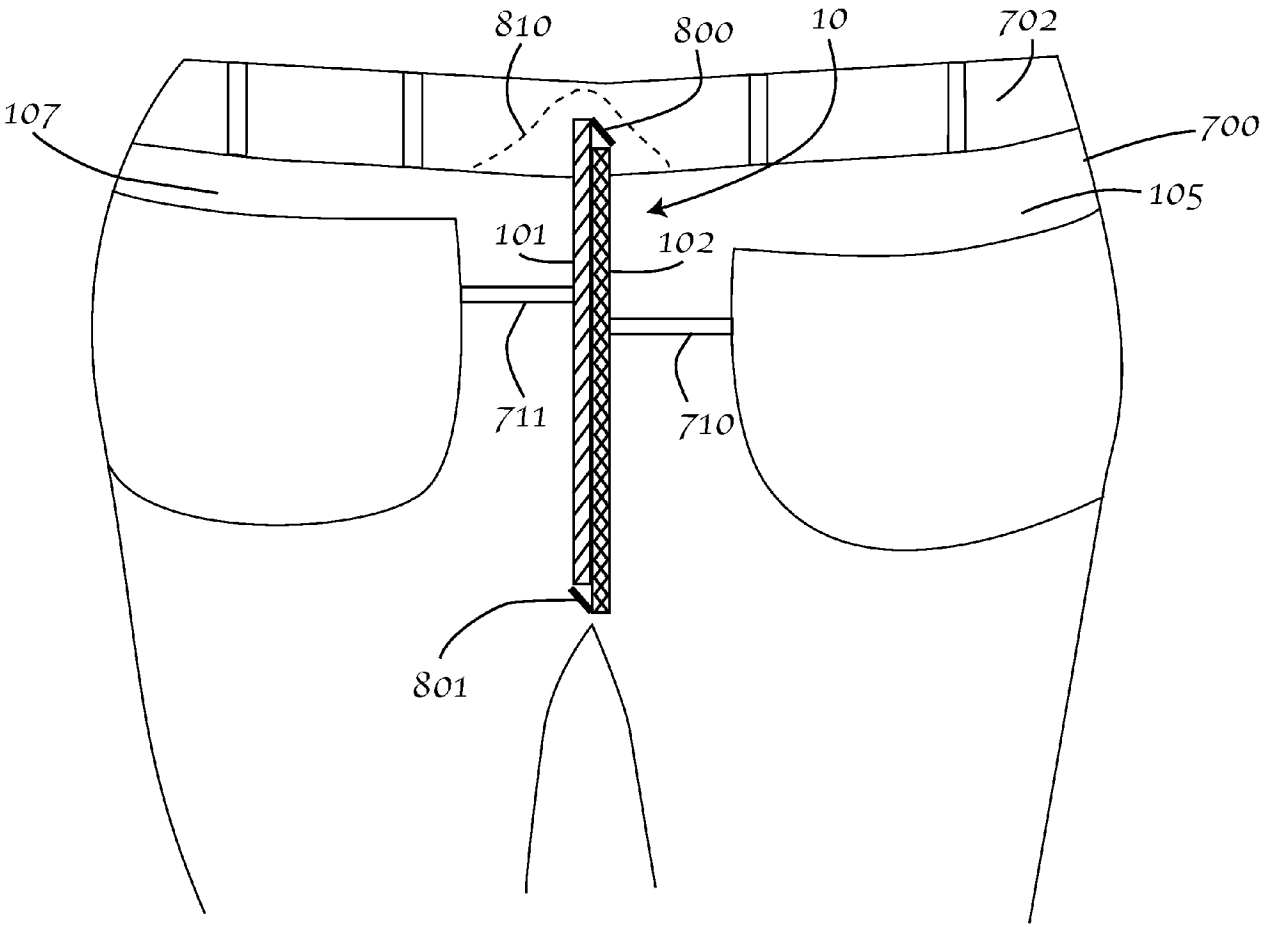
FIG. 9 is a close up illustration of a rear view of a pair of pants with one embodiment of the fastener invention and shows how the fastener allows the two sides of the pair of pants slidably move with respect to each other.

FIG. 9 is a detailed close up illustration of a rear view of a pair of pants with one embodiment of the fastener invention and shows how the fastener allows the two sides of the pair of pants slidably move with respect to each other. As shown in FIG. 9, the fastener 10 has been added to a pair of pants 700. The pair of pants 700 are preferably jeans, and include a waist band 702, design strips 710 and 71 1, female rib 101, male rib 102, fabric swatches or portions 105 and 107, upper attachment 800, and lower attachment 801. Cut-out 810 allows upper attachment 800 to be visible in FIG. 9. FIG. 9 shows how as the wearer of the pants 700 moves, the ribs slidably move with respect to each other. FIG. 9 also shows how upper and lower attachments 800 and 801 preferably limit how far the female and male ribs 101 and 102 slide. Design strips 710 and 711 show how fabric portion 105 is now lower with respect to fabric portion 107. FIG. 9 shows an example of how the fastener would move when the wearer of the pants 700 lifts her right leg. Fabric portion 105 is pulled downward as the wearer lifts her right leg. This causes male rib 102 to slide downward with respect to female rib 101, which is held essentially in place by fabric portion 107. This sliding movement enhances the look of the user's rear as he or she walks.

Figure 10:
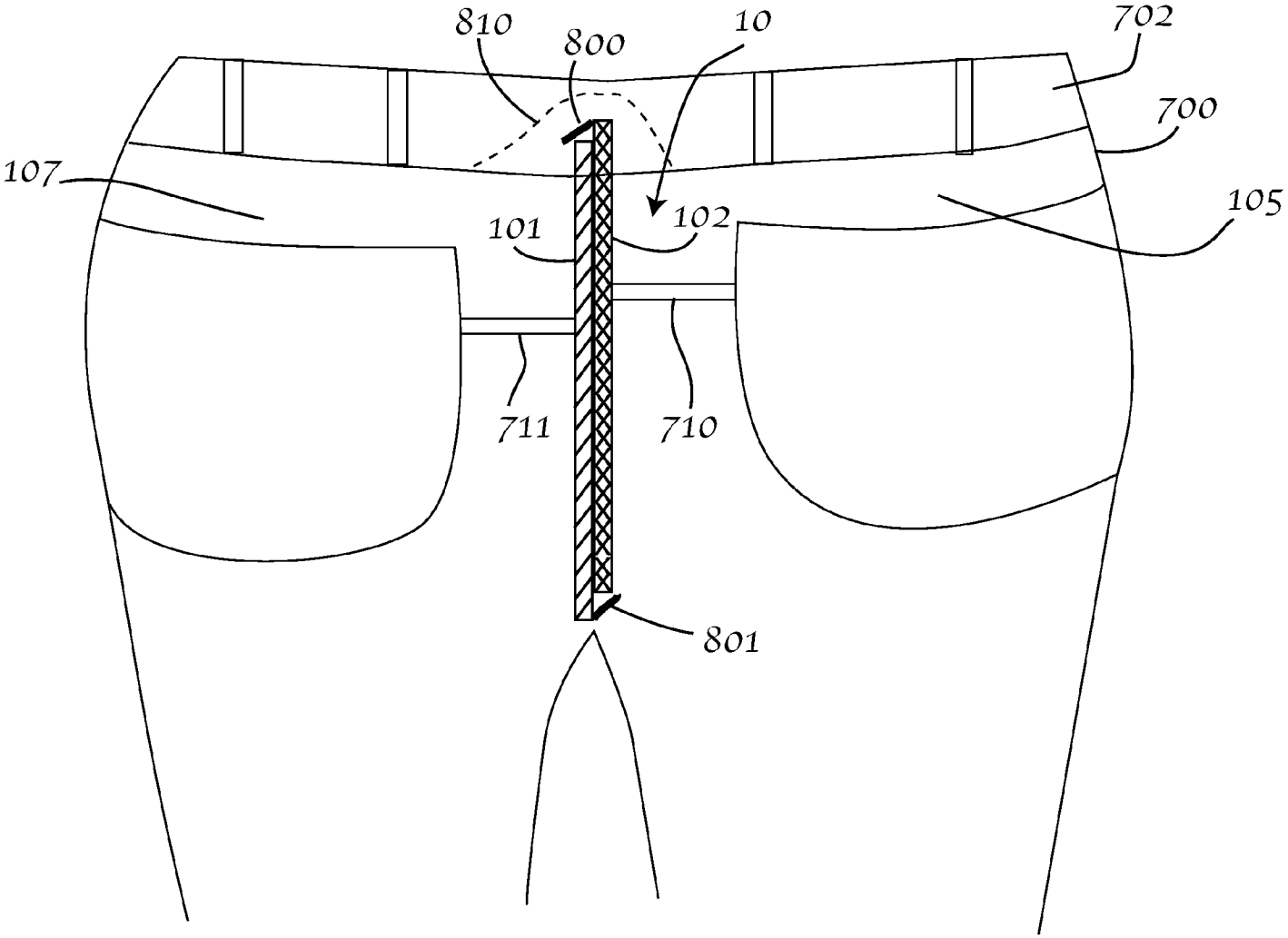
FIG. 10 is a close up illustration of a rear view of a pair of pants with one embodiment of the fastener invention and shows the pants sliding in an opposite direction.

FIG. 10 is a close up illustration of a rear view of a pair of pants with one embodiment of the fastener invention and shows the pants sliding in an opposite direction. As shown in FIG. 10, the fastener 10 has been added to a pair of pants 700. The pair of pants 700 are preferably jeans, and include a waist band 702, design strips 710 and 711, female rib 101, male rib 102, fabric swatches or portions 105 and 107, upper attachment 800, and lower attachment 801. Cut-out 810 allows upper attachment 800 to be visible in FIG. 10. FIG. 10 shows how as the wearer of the pants 700 moves, the ribs slidably move with respect to each other. FIG. 10 also shows how upper and lower attachments 800 and 801 preferably limit how far the female and male ribs 101 and 102 slide. In other words the attachments 800 and 801 prevent the female and male ribs 101 and 102 from completely sliding apart. Design strips 710 and 711 show how fabric portion 107 is now lower with respect to fabric portion 105 FIG. 10 shows an example of how the fastener would move when the wearer of the pants 700 lifts her left leg. Fabric portion 107 is pulled downward as the wearer lifts her left leg. This causes female rib 101 to slide downward with respect to male rib 102, which is held essentially in place by fabric portion 105. This sliding movement enhances the look of the user's rear as he or she walks.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A fastener, comprising: a male rib; a female rib; wherein said male rib is inserted into said female rib creating a permanently connected joint; and wherein said female rib and said male rib are slidable with respect to each other; a male fabric portion; a female fabric portion; wherein said male fabric portion is attached to said male rib; wherein said female fabric portion is attached to said female rib; a joint cover; wherein said permanently connected joint has an inside portion and an outside portion; wherein said joint cover covers said outside portion of said permanently connected joint such that said permanently connected joint appears to be a stitched seam; wherein said permanently connected joint is part of a wearable garment; wherein said permanently connected joint replaces a vertical rear seam on a pair of pants and wherein said female and male fabric portions are designed to cover a buttocks of a garment wearer; wherein said permanently connected joint has an upper attachment and a lower attachment; wherein a slidable motion of said permanently connected joint is limited by said upper attachment and said lower attachment; wherein said upper attachment and said lower attachment are comprised of a plurality of permanent stitches, such that access to said male rib and said female rib is prevented and disconnection of said male rib from said female rib is prevented.

2. The fastener of claim 1, wherein said wearable garment is a pair of jeans.

3. The fastener of claim 2, wherein said male rib and said female rib are made of a material selected from the group consisting of plastic and polytetrafluoroethylene.

4. The fastener of claim 3, wherein said male rib has a rounded arrow shape and wherein said female rib has an open end, wherein said open end of said female rib is shaped to accept said rounded arrow shaped male rib.

5. The fastener of claim 4, wherein said male rib is inserted into said female rib by pushing said male rib into said female rib such that said female rib widens said male rib and snaps into place.

6. The fastener of claim 5, wherein said rounded arrow shaped male rib has one or more rounded back portions that when engaged with said female rib prevents said male rib from being pulled free of said female rib.

7. The fastener of claim 6, wherein said permanently connected joint allows said female fabric portion and said male fabric portion to be designed to slidably move independently of each other and with said buttocks of said garment wearer as said garment wearer moves or walks.

8. A pair of pants, comprising: two rear leg portions; a waist band portion; a male rib; a female rib; a joint cover; wherein a first of said two rear leg portions is attached to said male rib; wherein a second of said two rear leg portions is attached to said female rib; wherein said male rib is matingly engaged with said female rib forming a rear joint; wherein said female rib and said male rib are slidable with respect to each other; wherein said rear joint connects said two rear leg portions to each other to form a back side of a pair of pants; wherein said rear joint allows said two rear leg portions to be designed to slidably move independently of each other and with a buttocks of said garment wearer as said garment wearer moves or walks; wherein said waist band portion is continuous above said rear joint and conceals a top of said rear joint; wherein said rear joint has an inside portion and an outside portion; wherein said joint cover covers said outside portion of said rear joint such that said rear joint appears to be a stitched seam.

9. The pair of pants of claim 8, wherein said male rib has a rounded arrow shape and wherein said female rib has an open end, wherein said open end of said female rib is shaped to accept said rounded arrow shaped male rib.

10. The pair of pants of claim 9, wherein said rounded arrow shaped male rib has one or more rounded back portions that when engaged with said female rib prevents said male rib from being pulled free of said female rib.

11. The pair of pants of claim 10, wherein said pair of pants is a pair of jeans.

12. The pair of pants of claim 11, wherein said male rib and said female rib are made of a material selected from the group consisting of plastic and polytetrafluoroethylene.

13. The pair of pants of claim 12, wherein said rear joint has an upper attachment and a lower attachment; wherein a slidable motion of said rear joint is limited by said upper attachment and said lower attachment; wherein said upper attachment and said lower attachment are comprised of a plurality of permanent stitches, such that access to said male rib and said female rib is prevented and disconnection of said male rib from said female rib is prevented.

14. The pair of pants of claim 8, wherein said rear joint has an upper attachment and a lower attachment; wherein a slidable motion of said rear joint is limited by said upper attachment and said lower attachment; wherein said upper attachment and said lower attachment are comprised of a plurality of permanent stitches, such that access to said male rib and said female rib is prevented and disconnection of said male rib from said female rib is prevented.

* * * * *